United States Patent [19]

Scullin, Jr.

[11] 4,329,973

[45] May 18, 1982

[54] ADAPTER FOR VENTING A STOVE THROUGH A FIREPLACE

[75] Inventor: Richard J. Scullin, Jr., Williamstown, Mass.

[73] Assignee: Mohawk Industries, Inc., Adams, Mass.

[21] Appl. No.: 106,480

[22] Filed: Dec. 26, 1979

[51] Int. Cl.[3] ..... F24B 7/00

[52] U.S. Cl. ..... 126/123; 126/137; 126/120; 126/318

[58] Field of Search ..... 126/120, 80, 82, 301, 126/312, 314, 315, 316, 317, 318, 319, 137; 98/58, 60; 138/120; 248/354 S

[56] References Cited

U.S. PATENT DOCUMENTS

| | | | |
|---|---|---|---|
| 1,864 | 1/1895 | Alston | 126/120 |
| 1,021,689 | 3/1912 | Lyon | 126/314 X |
| 1,336,700 | 4/1920 | Johnston | 126/121 |
| 3,139,882 | 7/1964 | White | 126/137 |
| 4,026,264 | 5/1977 | Henriques | 126/123 |
| 4,207,862 | 6/1980 | Meyer | 126/137 |

*Primary Examiner*—Samuel Scott
*Assistant Examiner*—Randall L. Green
*Attorney, Agent, or Firm*—Morse, Altman, Oates & Dacey

[57] ABSTRACT

An adapter is provided for use in venting a coal or wood burning stove through the flue of a fireplace. The adapter includes a fireproof board and a metal pressure plate, each formed with a central opening to receive the exhaust end of stove pipe from the stove. The board and plate are fitted into the fireplace flue and held there by means of a pair of longitudinally adjustable legs, the lower ends of which press against the floor of the fireplace. The pressure plate is provided with studs to receive the upper ends of the legs and tabs are provided on the plate at the sides of the stove pipe hole for fastening with the stove pipe.

2 Claims, 8 Drawing Figures

FIG. 3
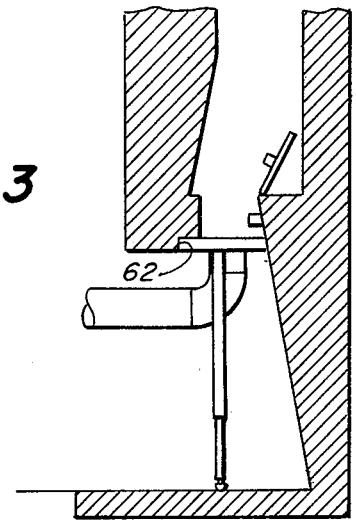
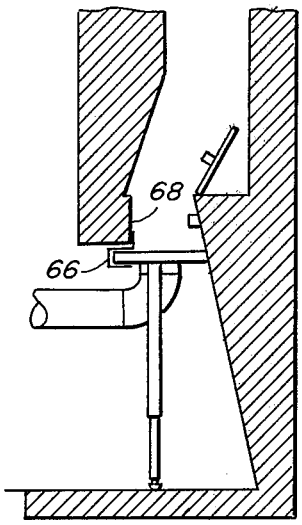
FIG. 4
FIG. 5
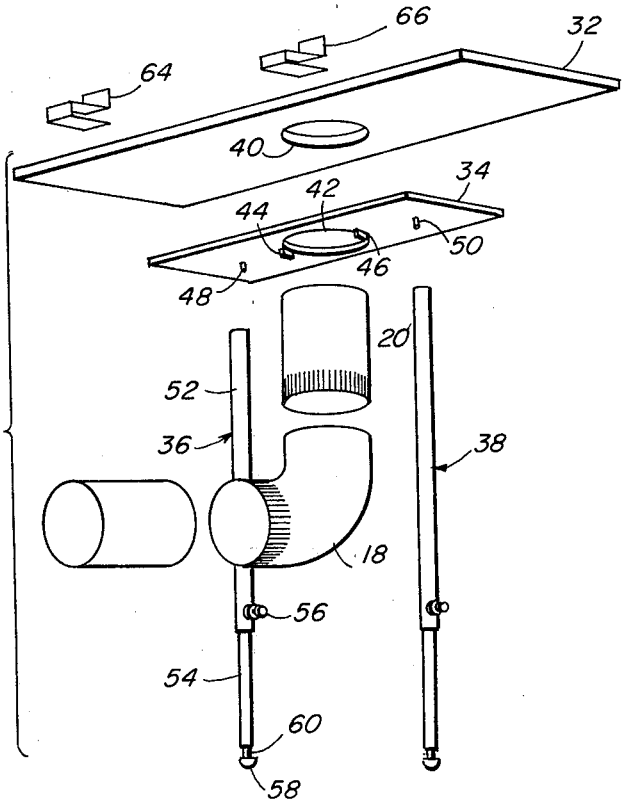
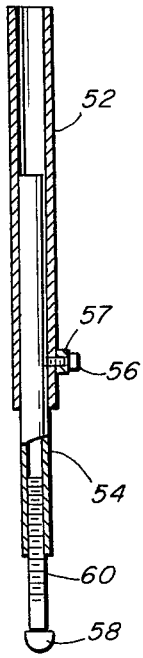
FIG. 8

ADAPTER FOR VENTING A STOVE THROUGH A FIREPLACE

BACKGROUND OF THE INVENTION

1. Field of the Invention

This invention relates generally to accessories for use with wood and coal burning stoves and more particularly is directed towards an adapter by means of which a wood or coal burning stove may be vented through a fireplace.

2. Description of the Prior Art

As is well known wood and coal burning stoves have been in use for a great many years, serving as both a heater for home and other buildings as well as for cooking purposes. Typically, stoves of this type have been vented through a stove pipe passing through a wall or roof of the building and, while this has long been the practice, it has a number of disadvantages. First of all, the stove pipe gets quite hot when the stove is in use and thus the pipe must be well insulated from the wall or roof of the building through which it is passing in order to reduce the risk of fire. Furthermore, the stove pipe itself is somewhat unsightly and many potential users of coal and wood burning stoves are deterred by the prospect of cutting openings through the walls of their houses despite obvious benefits obtained from having such a stove available.

While wood stoves have heretofore been vented through existing fire places, the connecting arrangements generally have been rather awkward and inefficient.

Accordingly, it is an object of the present invention to provide an adapter for connecting the vent of a coal or wood burning stove to the flue of a fireplace in a quick and simple manner. Another object of this invention is to provide an adapter for a use in venting a coal or wood burning stove to a fireplace by means of which the adapter may be readily fitted to a variety of different sizes and shapes of fireplaces and fireplace flues. Still another object of this invention is to provide an adapter of the foregoing type which is quickly and easily installed and which may be readily removed in order to return the fireplace to its original state.

SUMMARY OF THE INVENTION

This invention features an adapter for use in connecting the vent of a wood or coal burning stove to the flue of a fireplace, comprising a relatively large, flat fireproof board which is adapted to be readily cut to size to the flue opening and a smaller metal support plate mounted to the lower face of the board. Both the board and the plate are formed each with a circular opening through which the stove pipe extends from the stove to the flue. A pair of telescopic legs extends vertically from the lower face of the plate to the floor of the fireplace and are adjustable to accommodate fireplaces of different heights. Brackets are provided for use with unusual fireplace configurations for stabilizing the assembly. Tabs are formed on the plate adjacent the pipe opening for securing the plate to the pipe as by screws and downwardly extending posts serve to engage the upper ends of the legs for positioning thereof.

BRIEF DESCRIPTIONS OF THE DRAWINGS

FIG. 1 is a view in perspective, partially cut away, showing an adapter made according to the invention and in typical use, FIG. 2 is a view in side elevation, partly in section, of the adapter installation of FIG. 1, FIG. 3 is a view similar to FIG. 2 showing the adapter installed in a fireplace of a construction different from that of FIG. 2, FIG. 4 is a view similar to FIG. 2 showing the adapter installed in a fireplace of a still different construction and provided with stabilizing clips made according to the invention, FIG. 5 is an exploded view in perspective of the adapter, FIG. 6 is a bottom plan view of the pressure plate portion of the adapter, FIG. 7 is a view in side elevation thereof, and, FIG. 8 is a sectional view in side elevation of one of the support legs used with the adapter.

DETAILED DESCRIPTION OF THE PREFERRED EMBODIMENT

Figure 1:
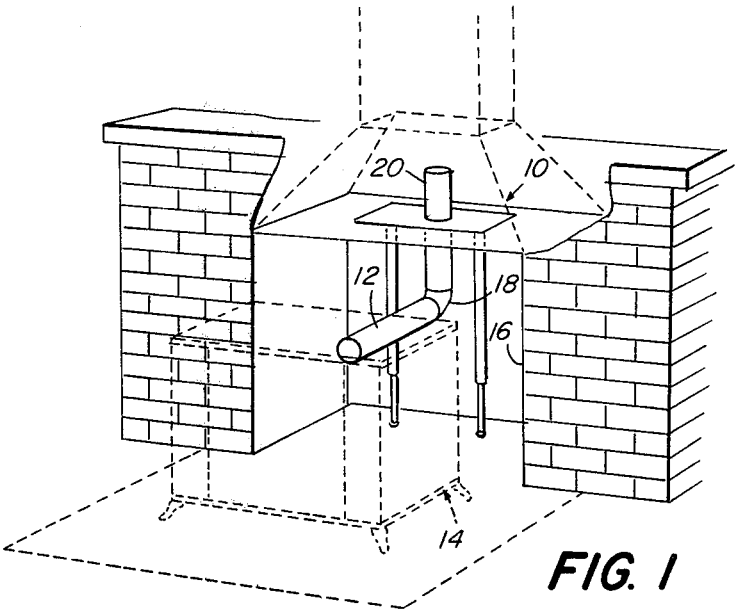
Figure 6:
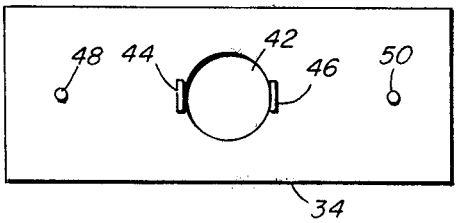
Figure 7:
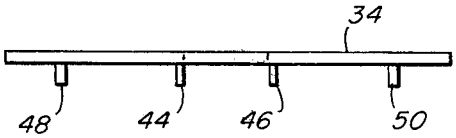
Figure 2:
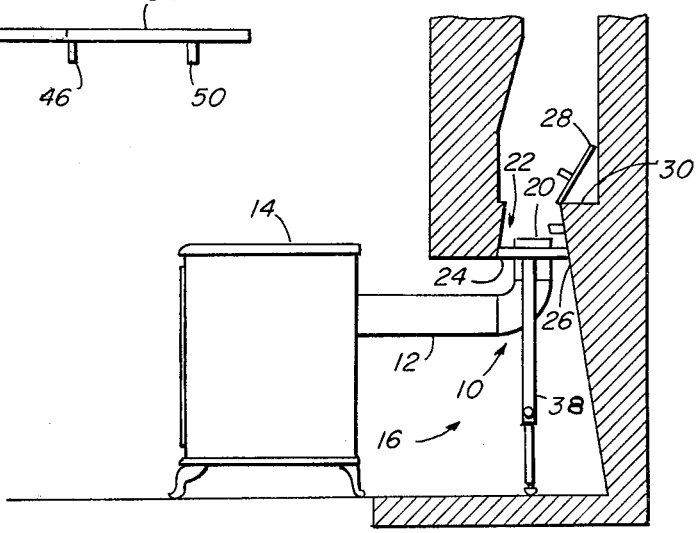

Referring now to the drawings, the reference character 10 generally indicates an adapter for use in connecting a length of stove pipe 12 from a coal or wood burning stove 14 to a fireplace 16. The stove 14 may be any one of a variety of commercially available coal or wood burning stoves. The illustrated stove is provided with a rear vent connected to the stove pipe 12, which, in the illustrated embodiment, extends horizontally into the open fireplace 16 and is provided with a right angle bend section 18 from which extends a vertical section of pipe 20 projecting into the uptake or throat 22 of the fireplace for venting up through the chimney. In the embodiment best illustrated in FIG. 2 the throat 22 of the fireplace is formed by upwardly converging front and rear walls 24 and 26 located below a damper 28 mounted at a smoke shelf 30 normally provided just above the throat 22.

The stove pipe sections 12, 18 and 20 are mounted in position by means of the adapter 10 comprised of a board 32 of generally rectangular configuration fabricated of a suitable fireproof material, a pressure plate 34, also preferably rectangular and of a somewhat smaller dimensions than the board 32 and a pair of adjustable legs 36 and 38 extending from the lower face of the pressure plate 34 to the floor of the fireplace in the manner illustrated.

The fireproof board 32 may be fabricated from a variety of different fireproof material such as a composite of organic and inorganic compounds which are resistant to temperatures on the order of 2600° F. and which form into a relatively stiff, self-supporting board that is not flaky and is easy to cut. In practice the board should have a length and width sufficient to block the throat of most conventional fireplaces and, for this purpose a length of perhaps 48" and a width of perhaps 24" is sufficient. The board thickness typically is ½". Obviously these dimensions are only by way of example and can be altered. Preferably the boards should be slightly oversized to cover a maximum number of fireplace openings and then cut to the size of the particular flue opening to which the adapter is to be mounted. This may be done readily by employing a cardboard template and by making appropriate measurements of the fireplace throat and cutting out a template in cardboard to first establish a preliminary fit. The template may then be used to mark and cut the board 32 to provide a good wedging fit into the throat of the fireplace. Any irregularities in the brickwork or other gaps that may exist may be filled with fiberglass or other suitable insulating material. With the board cut to proper size a circular opening 40 is cut at or near the center of the board to receive the vertical stove pipe section 20 which extends therethrough, as shown. The opening 40 may be readily formed by placing the end of the pipe section against the board, tracing the pipe on the board then cutting through the board along the trace mark.

The underlying pressure plate 34 preferably is fabricated from a relatively heavy gauge steel, 11 gauge for example, sufficient to provide firm support to the board and is of a size sufficient to provide uniform pressure up against the board when pressure is furnished by the support legs. For this purpose dimensions of 18"×10" have been found satisfactory. The pressure plate typically is provided with a preformed central opening 42 of a size corresponding to the diameter of the stove pipe being used. Typically, stove pipe comes in 6" or 8" diameter sizes although obviously other sizes may be employed. The pressure plate is provided with a pair of downwardly projecting tabs 44 and 46, one on each side of the opening 42 and each tab is provided with a small opening to accommodate sheet metal screws which are also driven into the walls of the stove pipe in order to attach the stove pipe firmly to the pressure plate. Holes in the stove pipe may be readily formed by means of an electric drill or the like. In addition to screwing the stove pipe section 20 to the pressure plate, all sections of the stove pipe, including the bent portion 18, should be fastened to one another by sheet metal screws to insure a good, permanent, tight fit amongst the stove pipe sections. The pressure plate is also provided with a pair of downwardly projecting studs 48 and 50 which are adapted to engage the upper ends of the legs 36 and 38 in order to hold the legs in position with respect to the pressure plate. The studs should be of a sufficient length and width to fit neatly into the upper ends of the legs.

The legs 36 and 38 are identical and are formed from a pair of telescopic tubular sections 52 and 54 with a thumb screw 56 threaded through a cooperating nut 57 provided near the lower end of the section 52 for locking the sections 52 and 54 at a selected extended position corresponding generally to the height between the floor of the fireplace and the pressure plate 34. At the lower end of the section 54 a pressure foot 58 is provided. The foot 58 is formed with a threaded shank portion 60 which threads into the tapped lower end of the section 54 and may be extended or retracted by turning the head 58 clockwise or counterclockwise, as required. Once the two legs are in position and the general length of the telescopic sections has been set, pressure is applied to the plate by turning the pressure foot so as to effectively lengthen each leg and apply pressure on the plate. Upward pressure on the plate is transferred to the fireproof board which then presses the edges of the board against the walls of the throat of the fireplace to form a substantially air-tight seal therewith. Typically, the leg sections 52 and 54 are provided in 30" lengths with the upper section 52 having a 19 gauge wall and a 1" diameter while the lower section 54 has an 18" gauge wall and a $\frac{7}{8}$" diameter.

Referring now to FIG. 3 of the drawings there is illustrated an adapter 10 installed in a fireplace having a stepped lintle. The stepped lintle, as shown, defines a step 62 which is highly suitable for receiving the forward edge of the fireproof board and produces a very stable installation of the adapter since the board is then restrained from moving either forwards, backwards, or upwards with the legs providing proper support from the bottom thereof.

Referring now to FIG. 4 of the drawings, there is illustrated a fireplace in which the lintle is flat along the lower edge and the front wall of the throat is vertical. In order to stabilize the adapter for this type of fireplace, a pair of clips 64 and 66 is provided. Each clip is generally U-shaped and preferably fabricated from sheet metal or the like. As shown, the U-shaped clip is dimensioned to fit snugly over the foward edge of the board 32 and is provided with an upwardly extending ear 68 adapted to engage the inner edge of the lintle at the vertical front wall so as to prevent forward movement of the board once installed.

The adapter may be used with a wide variety of fireplaces of different sizes and shapes and yet will provide a snug fit with the fireplaces so as to prevent smoke from backing down into the fireplace. It is quickly and easily installed and, in the event that the stove is to be moved for any reason, the adapter may be quickly disassembled in order to restore the fireplace to its original condition.

Having thus describe the invention, what I claim and desire to obtain by Letters Patent of the United States is:

1. An adapter for connecting the vent of a stove to the flue of a fireplace, comprising (a) a generally rectangular panel of a relatively rigid self-supporting thermal insulating material adapted to be formed with a circular opening to receive a section of stove pipe therethrough, (b) a relatively stiff unitary flat metal plate of similar shape to said panel and of smaller dimensions adapted to be mounted against the lower face of said panel and formed with a circular opening therethrough of a size generally corresponding with the opening in said panel and adapted to register therewith.

(c) a pair of telescopic tubular legs adapted to be braced in spaced parallel relation between the floor of said fireplace and the lower face of said plate, (d) locking means operatively associated with each of said legs for locking each leg at a selected extended position, (e) length adjustment means independent of said locking means operatively associated with at least one end of each of said legs, (f) said adjustment means including a screw threaded coaxially to said one end whereby the effective length of said leg may be altered by selective rotation of said screw, and, (g) said plate being formed with a pair of downwardly extending studs mounted in spaced relation to the lower face of said plate, one on each side of said opening and adapted to engage the tubular upper ends of said legs, (h) said screw being mounted to the lower end of said leg and including an enlarged head at the outer end thereof, (i)said plate being formed with at least a pair of downwardly extending flat tabs at opposite edges of said plate opening and tangential thereto and each formed with a hole therethrough to receive a screw for fastening said plate to said stove pipe sections.

2. An adapter according to claim 1 including at least one clip adapted to engage an edge of said panel and an edge of said flue for stabilizing said panel against lateral displacement, said clip being formed with a U-shaped portion adapted to engage the edge of said panel and a flue edge engaging portion extending perpendicularly from one of the legs of said U-shaped portion.

* * * * *